US008007276B2

(12) United States Patent
Melgaard et al.

(10) Patent No.: US 8,007,276 B2
(45) Date of Patent: Aug. 30, 2011

(54) FIBER TREATMENT OVEN WITH ADJUSTABLE GATES

(75) Inventors: Hans L. Melgaard, North Oaks, MN (US); Michael J. Franklin, Apple Valley, MN (US)

(73) Assignee: Despatch Industries Limited, Lakeville, MN (US)

( * ) Notice: Subject to any disclaimer, the term of this patent is extended or adjusted under 35 U.S.C. 154(b) by 675 days.

(21) Appl. No.: 12/098,541

(22) Filed: Apr. 7, 2008

(65) Prior Publication Data

US 2009/0253091 A1 Oct. 8, 2009

(51) Int. Cl.
*F26B 13/00* (2006.01)
*F27B 9/28* (2006.01)

(52) U.S. Cl. ..... 432/8; 432/56; 432/250; 34/643

(58) Field of Classification Search ..... 432/8, 56, 432/57, 59, 250; 264/173.15, 290.2, 173.14, 264/210.7, 235.8; 148/566; 34/643
See application file for complete search history.

(56) References Cited

U.S. PATENT DOCUMENTS

| | | | | |
|---|---|---|---|---|
| 4,487,214 | A * | 12/1984 | Tatum | 137/72 |
| 4,515,561 | A * | 5/1985 | Melgaard | 432/136 |
| 4,541,328 | A | 9/1985 | Brzezinski et al. | |
| 5,009,016 | A * | 4/1991 | LePisto et al. | 34/421 |
| 5,299,469 | A | 4/1994 | Meyer et al. | |
| 5,427,366 | A * | 6/1995 | Sakamori | 271/125 |
| 5,908,290 | A * | 6/1999 | Kawamura et al. | 432/59 |
| 5,915,958 | A * | 6/1999 | Kurie | 432/89 |
| 6,431,858 | B1 * | 8/2002 | Rutz | 432/59 |
| 6,776,611 | B1 * | 8/2004 | Sprague | 432/64 |
| 7,335,018 | B2 * | 2/2008 | Yamaguchi | 432/59 |

* cited by examiner

*Primary Examiner* — Gregory A Wilson
(74) *Attorney, Agent, or Firm* — Fredrikson & Byron, P.A.

(57) ABSTRACT

A fiber treatment oven having slots for the fibers to pass through and adjustable gates located proximate the slots. The gates may be connected via a linkage that allows movement of many gates at once and may be connected so that individual gates may be adjusted as well.

16 Claims, 5 Drawing Sheets

FIBER TREATMENT OVEN WITH ADJUSTABLE GATES

BACKGROUND

Fibers, and particularly organic fibers, often require heat treatment to develop certain properties. Rayon fibers or fibers of polyaerylonitrile or polyacrylonitrile, for example, may be converted to a conductive (carbonaceous) form through high-temperature treatment. Heat is also employed in the drying of coatings or dyes upon a variety of synthetic or natural fibers.

Various ovens have been developed for the heat treatment of fibers. The fibers commonly are supported on rolls or spools, and such ovens may be provided with a device at one end for unrolling and feeding a length of fibers into the oven, and a take-up roller or spool at the other end of the oven for winding up the heated length of fibers. In some ovens, the fibers make several passes through the oven and rollers or spools are located at each end of the oven to collect the fibers exiting the oven and redirect them to the oven for another pass. Many entry and exit points through the oven wall are required in these embodiments.

BRIEF SUMMARY OF EMBODIMENTS OF THE INVENTION

In one embodiment in accordance with the invention, a fiber treatment oven includes a heated enclosure for heating fibers as the fibers are drawn through the enclosure. In this embodiment the enclosure has two end walls with a plurality of slots in the end walls to allow fibers to be fed to and from the enclosure. There are a plurality of adjustable gates located proximate the slots and configured to increase or decrease the effective area of the slots and a linkage connecting at least some of the gates so that more than one gate can be adjusted at a time.

In another embodiment in accordance with the invention, a fiber treatment oven includes a heated enclosure for heating fibers as the fibers are drawn through the enclosure. In this embodiment the enclosure has two end walls with a plurality of slots in the end walls to allow fibers to be fed to and from the enclosure. There are a plurality of adjustable gates located proximate the slots and configured to increase or decrease the effective area of the slots and a linkage connecting at least some of the gates so that more than one gate can be adjusted at a time. In this embodiment a rotating gate is disposed above each of the plurality of slots and a complementary rotating gate is disposed below each of the plurality of slots. In some optional embodiments, a flexible overlay may be installed on the portion of a gate that is proximate the fibers.

In another embodiment, a fiber treatment oven includes a heated enclosure for heating fibers as the fibers are drawn through the enclosure. In this embodiment the enclosure has two end walls with a plurality of slots in the end walls to allow fibers to be fed to and from the enclosure. There are a plurality of adjustable gates located proximate the slots and configured to increase or decrease the effective area of the slots and a linkage connecting at least some of the gates so that more than one gate can be adjusted at a time. In this embodiment a rotating gate is disposed above each of the plurality of slots and a complementary rotating gate is disposed below each of the plurality of slots. In this embodiment the gates are attached to the end wall at a proximal edge by hinges and are operatively connected to a first linkage at a first end of a distal edge. The oven of this embodiment has a drive unit to drive the rotation of the linkage and a universal joint that compensates for the movement of the linkage caused when the distal ends of the gates rotate.

In yet another embodiment, a fiber treatment oven includes a heated enclosure for heating fibers as the fibers are drawn through the enclosure. In this embodiment the enclosure has two end walls with a plurality of slots in the end walls to allow fibers to be fed to and from the enclosure. There are a plurality of adjustable gates located proximate the slots and configured to increase or decrease the effective area of the slots and a linkage connecting at least some of the gates so that more than one gate can be adjusted at a time. In this embodiment a rotating gate is disposed above each of the plurality of slots and a complementary rotating gate is disposed below each of the plurality of slots. In this embodiment the gates are attached to the end wall at a proximal edge by hinges and are operatively connected to a first linkage at a first end of a distal edge. The distal ends of the gates are operatively connected to nuts, and the nuts on the gates above each slot are threaded in the opposite direction from the nuts on the gates below each slot. The nuts are threaded onto the first linkage, the first linkage having alternating thread directions to match each nut so that when the first linkage is rotated the gates above each slot move in opposite directions from the gates below each slot. In some alternative embodiments, as similarly configured second linkage is operatively connected to the gates at a second end of the gates generally opposite the first end. In these embodiments, both linkages may optionally be operatively connected so that they can be rotated to essentially the same degree at the same time.

In yet another embodiment, a fiber treatment oven includes a heated enclosure for heating fibers as the fibers are drawn through the enclosure. In this embodiment the enclosure has two end walls with a plurality of slots in the end walls to allow fibers to be fed to and from the enclosure. There are a plurality of adjustable gates located proximate the slots and configured to increase or decrease the effective area of the slots and a linkage connecting at least some of the gates so that more than one gate can be adjusted at a time. In this embodiment a rotating gate is disposed above each of the plurality of slots and a complementary rotating gate is disposed below each of the plurality of slots. In this embodiment the gates are attached to the end wall at a proximal edge by hinges and are operatively connected to a first linkage at a first end of a distal edge. The distal ends of the gates are operatively connected to nuts, and the nuts on the gates above each slot are threaded in the opposite direction from the nuts on the gates below each slot. The nuts are threaded onto the first linkage, the first linkage having alternating thread directions to match each nut so that when the first linkage is rotated the gates above each slot move in opposite directions from the gates below each slot. This embodiment includes a collar that attaches the nut to the gate, the collar being selectively secured to the nut so that the nut can be moved along the linkage to a new position and then secured again to the collar at the new position.

In another embodiment in accordance with the invention, An oven for treating fibers has a housing defining a plurality of spaced, parallel pathways for a plurality of fibers to traverse the interior of the housing in the direction of and along the pathways. This embodiment includes a roller located outside of the housing to collect fibers at the end of a pathway and to direct fibers to a next pathway. The housing has a plurality of slots to allow the fibers to enter and exit the housing. There are a plurality of adjustable gates located proximate the slots and configured to increase or decrease the effective area of the slots. A linkage connects at least some of the gates so that more than one gate can be adjusted at a time.

In yet another embodiment in accordance with the invention, An oven for treating fibers has a housing defining a plurality of spaced, parallel pathways for a plurality of fibers to traverse the interior of the housing in the direction of and along the pathways. This embodiment includes a roller located outside of the housing to collect fibers at the end of a pathway and to direct fibers to a next pathway. A rotating gate is disposed above each of a plurality of slots and a complementary rotating gate is disposed below each of a plurality of slots. The gates have a proximal edge and a distal edge along the length of the gate, and a first end and a second end, and are attached to the housing at the proximal edges by hinges. There are nuts operatively connected to the ends of the gates proximate the distal edges, and the nuts on the gates above each slot are threaded in the opposite direction from the nuts on the gates below each slot. This embodiment includes a linkage having alternating thread directions to match each nut so that when the linkage is rotated in one direction the gates above the slot pivot so that their distal ends move downward while the gates below the slot pivot so that their distal ends move upward. The combination of the distal ends of the gates moving toward each other reduces the effective area of the slot. In some embodiments this oven optionally includes a drive unit to drive the rotation of the linkage and a universal joint that compensates for the movement of the linkage caused when the distal ends of the gates rotate.

In still another embodiment in accordance with the invention, an oven for treating fibers includes a housing defining a plurality of spaced, parallel pathways for a plurality of fibers to traverse the interior of the housing in the direction of and along said pathways. The housing has a plurality of slots in the housing to allow the fibers to enter and exit the housing. There is a vestibule at the end of the housing having a plurality of slots to allow the fibers to enter and exit the vestibule. Both the housing and the vestibule have a rotating gate disposed above each of a plurality of slots in the vestibule and housing and a complementary rotating gate disposed below each of a plurality of slots in the vestibule and housing. The gates have a proximal edge and a distal edge along the length of the gate, and a first end and a second end, and are attached to the housing or vestibule at the proximal edges by hinges. Nuts are operatively connected to the ends of the gates proximate the distal edges, and the nuts on the gates above each slot are threaded in the opposite direction from the nuts on the gates below each slot. There is a linkage connecting at least some of the gates of the housing and a second linkage connecting at least some of the gates of the vestibule. The linkages allow more than one gate at the housing and more than one gate at the vestibule to be adjusted at a time. The linkages have alternating thread directions to match each nut so that when the linkages are rotated in one direction the gates above the slot pivot so that their distal ends move downward while the gates below the slot pivot so that their distal ends move upward, the combination of the distal ends of the gates moving toward each other reducing the effective area of the slot.

DESCRIPTION OF EMBODIMENTS OF THE INVENTION

Fiber treatment ovens that have many inlets and outlets in the oven enclosure to allow tows of fibers to enter and exit the oven may encounter issues such as heat loss, temperature variations in the process, and other detrimental performance issues. At the same time, the openings for the fibers must be large enough to allow access for threading the fibers through the oven and allowing for variations in fiber position as, for example, the oven expands or shifts during operation.

Figure 1:
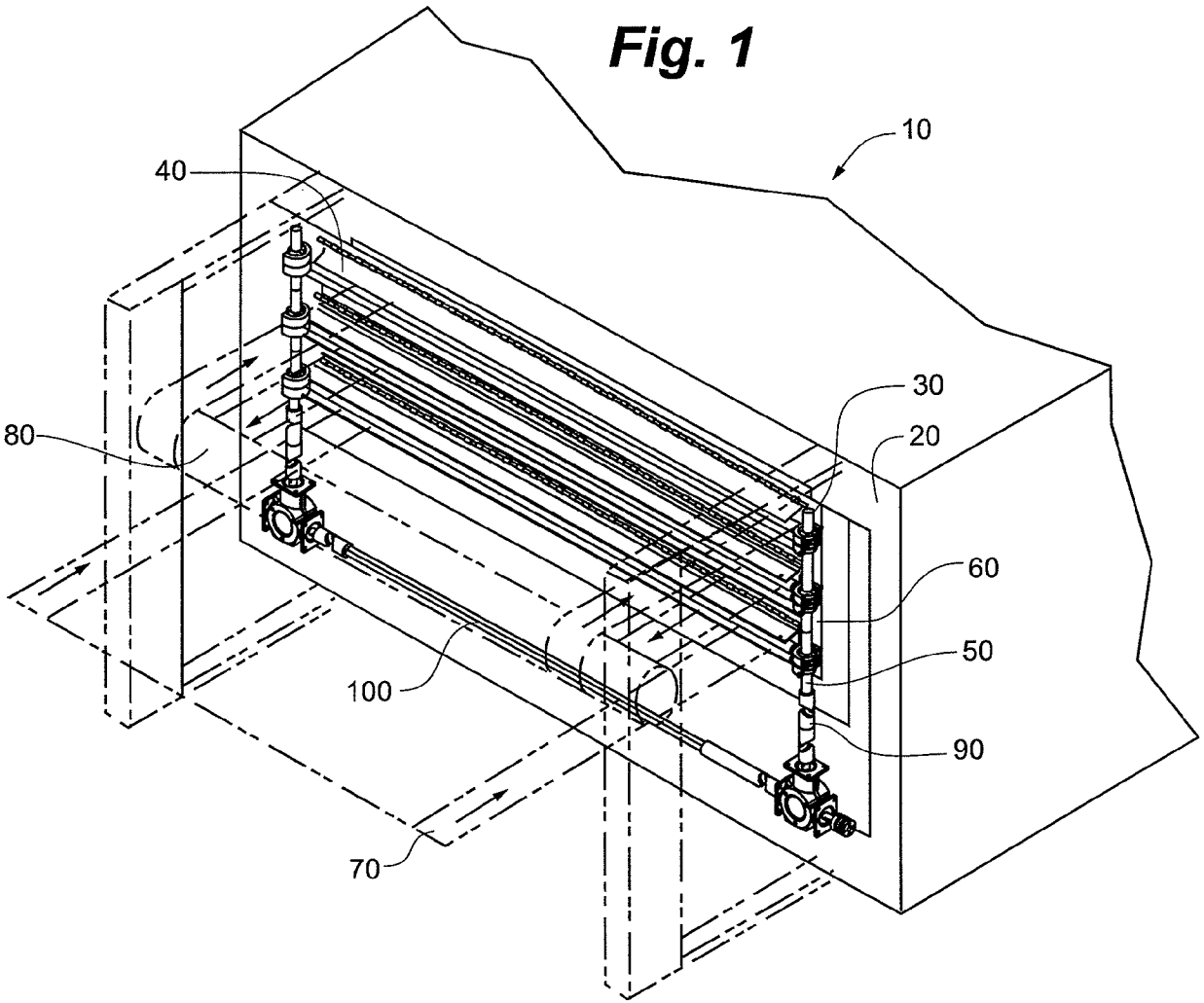
FIG. 1 is a perspective view of an oven in accordance with embodiments of the invention.

FIG. 1 is a perspective view of an oven in accordance with embodiments of the invention. The oven 10 has an end wall 20 with a plurality of slots 30 formed in the end wall. A plurality of adjustable gates 40 are located near the slots and a linkage 50 connects the gates so that more than one gate can be operated at a time. A seal plate 60 near the ends of the slots reduces heat loss.

Fiber tows 70 are drawn through the oven 10 of this embodiment in generally horizontal transverse passes and travel in the directions indicated by the arrows in FIG. 1. Rollers 80 at each end of the oven collect the fibers 70 as they exit one pass through the oven 10 and redirect them to the next pass.

The linkage 50 of this embodiment includes a universal joint 90, in this case made up of two transversely disposed pivots connected together. Any universal joint known in the art could be used and is contemplated by this disclosure. The universal joint 90 in this embodiment may perform a number of functions. For example, the oven may expand slightly as it is brought up to operating temperatures. In cases where the linkage 90 is attached to a drive mechanism 100, the universal joint 90 may compensate for a displacement due to thermal expansion of the oven 10. Also, as the gates 40 open and close (discussed below) the ends of the gates that are attached to the linkage in this embodiment move closer to or further from the end wall 20 based on their position. The universal joint 90 allows the linkage 50 to move with the gates 40 without placing mechanical stress on any drive mechanism, in cases where a drive mechanism is present.

Gates such as those described herein may be used to reduce the air interchange between the oven's interior and the outside environment. This may provide benefits including, but not limited to, reduced heat loss to the environment and related energy savings, improved control of oven operating conditions, and a more consistent temperature profile within the processing environment and better quality control of treated end products.

Figure 2:
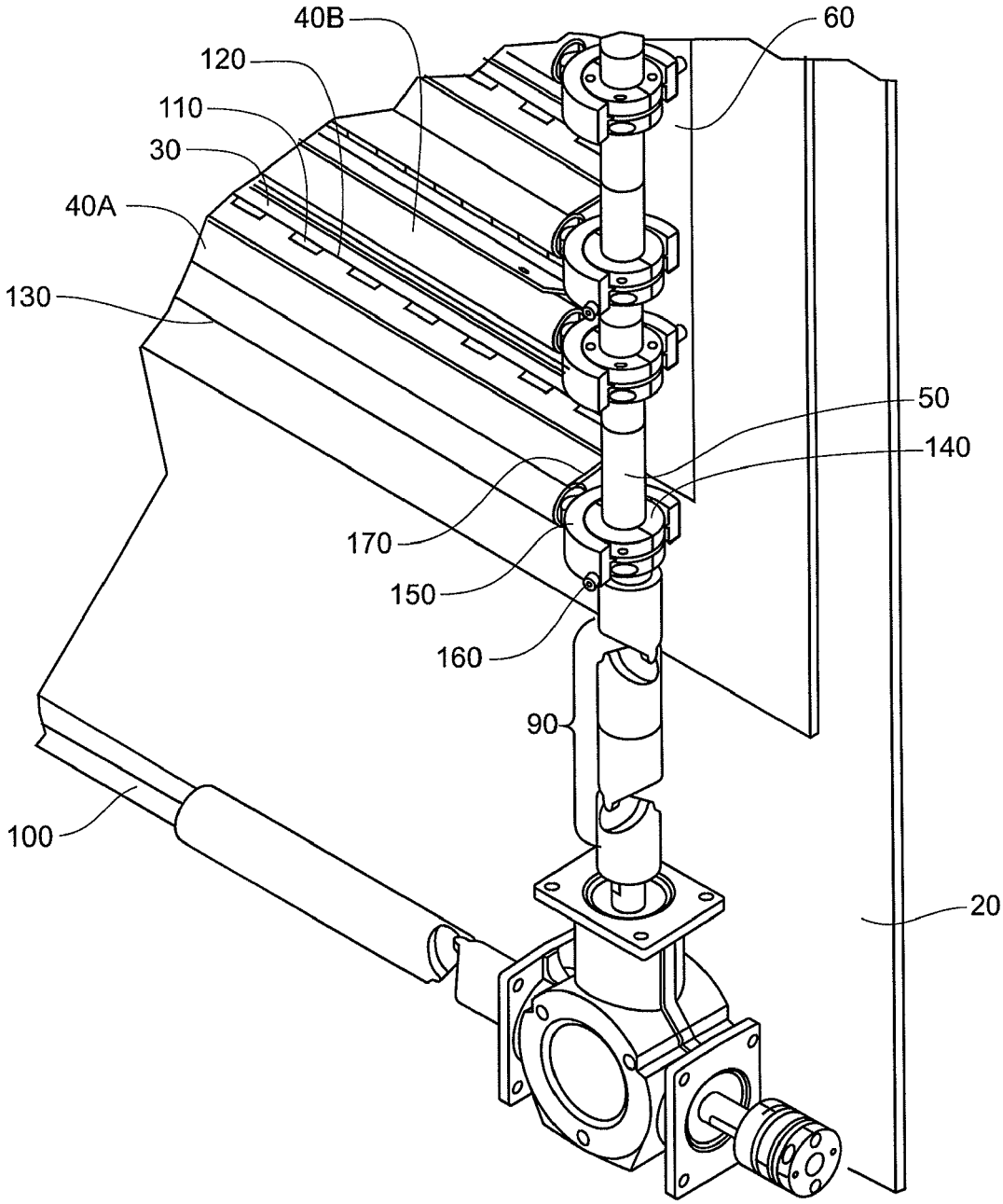
FIG. 2 is a perspective view of a portion of the embodiment of FIG. 1.

FIG. 2 is a perspective view of a portion of the embodiment of FIG. 1. The gates 40 have a proximal edge 120 running the length of the gate and proximate the end wall 20 and a distal edge 130. The gates 40 of this embodiment are operatively connected to the linkage 90 at their ends 170. In this embodiment, the gates are connected to a collar 150 that retains a nut 140. The nut 140 can be of any shape and the only requirement is that it has a threaded hole formed through it.

The slot 30 in FIG. 2 has a gate 40A below it and a second gate 40B above it. The nut 140 associated with gate 40A is threaded in one direction and the nut 140 associated with gate 40B is threaded in the opposite direction. For example, if the nut associated with gate 40A has what is commonly referred to as right-hand threads, the nut associated with gate 40B will have left hand threads. The linkage 50 of this embodiment has alternating sections of right hand threads and left hand threads corresponding with the nuts in that region of the linkage and the pattern is repeated as necessary for the gates that are operatively connected to the linkage.

The configuration just describe allows one to open and close a series of gates 40 by rotating a single linkage 50. Because the top gate 40B of a set of gates is operatively connected to a nut having the opposite thread direction of the nut connected to bottom gate 40A, rotating the common linkage causes each gate to move in the opposite direction of the other. Thus if gate 40A is moving up, gate 40B is moving down and the gates are cooperating to reduce the effective area of slot 30. Reducing the effective area of the slot 30 entails reducing the amount of the slot that is exposed to the environment beyond the gates. That is, the gates occlude or conceal a greater portion of the slot as the come together, and a lesser portion as they move apart.

Another feature of the embodiment shown in FIG. 2 is the optional collar 150 that operatively connects the nut 140 to the end 170 of the gate 40. The collar 150 of this embodiment can be selectively disengaged from the nut 140. The nut 140 can then be moved up or down along the linkage 50, allowing each gate 40—and in the case of embodiments with a linkage 50 on both ends of the gate, each end of each gate—to be adjusted independently. Once the nut 140 is located at the desired position on the linkage 50, the nut 140 can be secured to the collar 140 using, for example, a set screw 160.

The collar/nut arrangement, as well as other arrangements that will be obvious to those of skill in the art upon reading this disclosure, allows for maximum flexibility in setting and controlling gates such as those in FIG. 2. If a tow of fibers generally runs through a lower portion of slot 30, gates 40A and 40B can be adjusted to operate around that tow by lowering both nuts 140 so that gates 40A and 40B generally open and close about the tow of fiber itself.

In some embodiments a second linkage is located at an end of the gates generally opposite the end of the gates shown in FIG. 2. In these embodiments, the collar nut arrangement can allow for separate adjustment of each end of the gates. If the tow of fibers is lower at one end than the other, for example, the nuts associated with each gate and with each end of each gate, can be adjusted separately. The gate can effectively be tilted to some degree to follow the orientation of the fiber tow and, if the two linkages are operatively connected, the gates will move together to maintain consistent clearance from the fiber tow.

Figure 3:
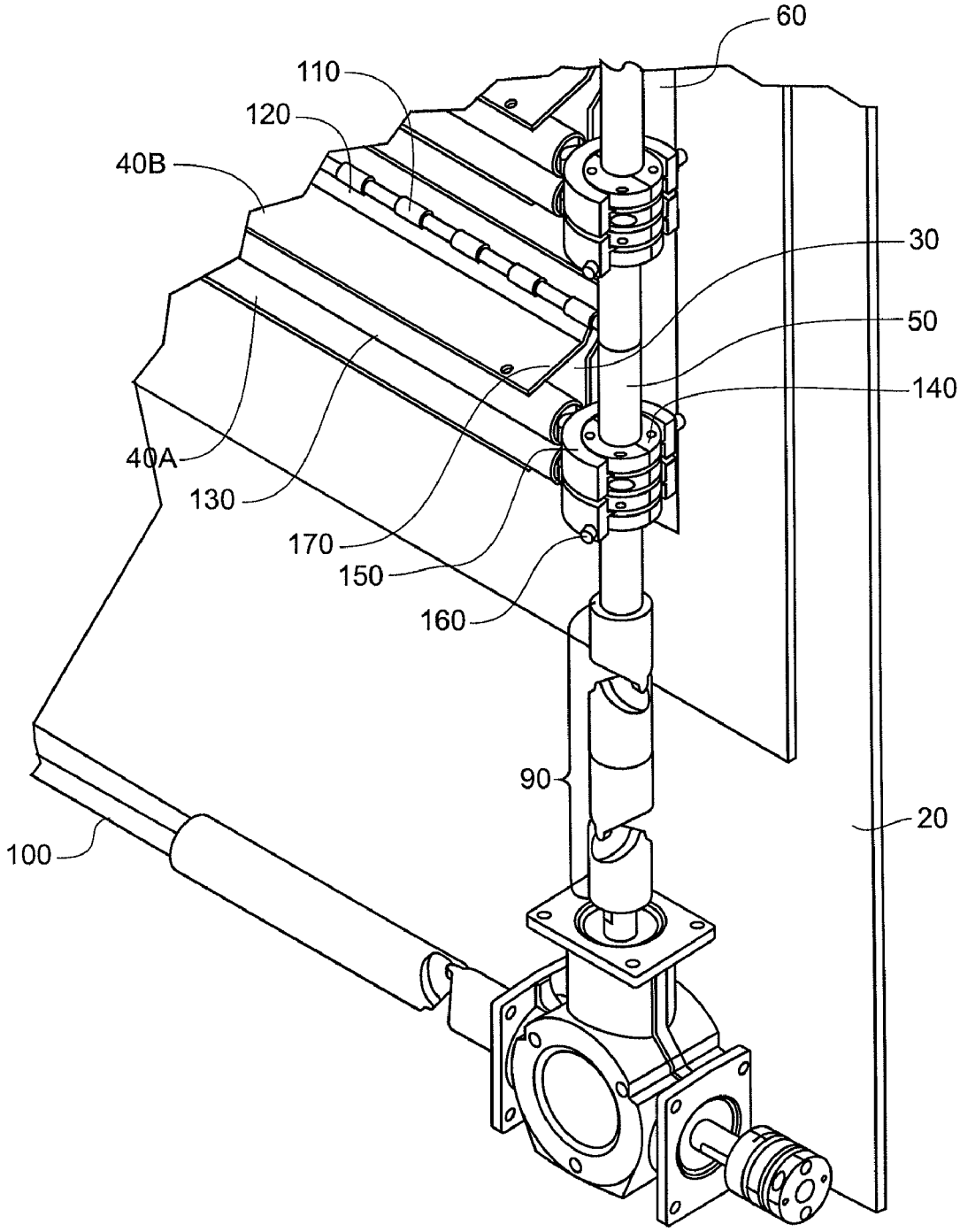
FIG. 3 is a perspective view of the embodiment of FIG. 2 with the gates in a more closed position.

The gates of FIG. 2 are shown in a generally open position. FIG. 3 is a perspective view of the embodiment of FIG. 2 with the gates in a more closed position. In this embodiment it can be seen that the nuts 140 for the top gate 40B and the bottom gate 40A are much closer together than the nuts in the embodiment shown in FIG. 2. The components of FIG. 3 are the same as the components of FIG. 2, only the position of the gates is changed to show how this embodiment operates.

The gates of embodiments of the invention could include a coating on the surface proximate the fibers to minimize the effects of any interaction between the gates and the fibers. A soft or lubricious coating could minimize damage to fibers in the event that the gates contacted the fibers. In some embodiments, a flexible bumper apparatus could be added to the gates proximate the fibers. This flexible bumper could, for example, be a hollow silicon rubber "tadpole" gasket such as is commonly used on oven doors. Such a gasket could be installed in a track that is secured to the gate in the appropriate position, and the gasket could be removed if necessary due to wear or degradation. Such gaskets can be made of many materials such as high temperature fiber glass, silicon rubber, and any flexible material suitable for the operating conditions of a particular fiber oven. The bumper could flex when, for example, a knot or tangle in the fiber passes between the gates. This would allow for operation of the gates with the bumper very close to the fiber without detrimental impacts to the fiber that might be caused by a gate without a bumper.

Figure 4:
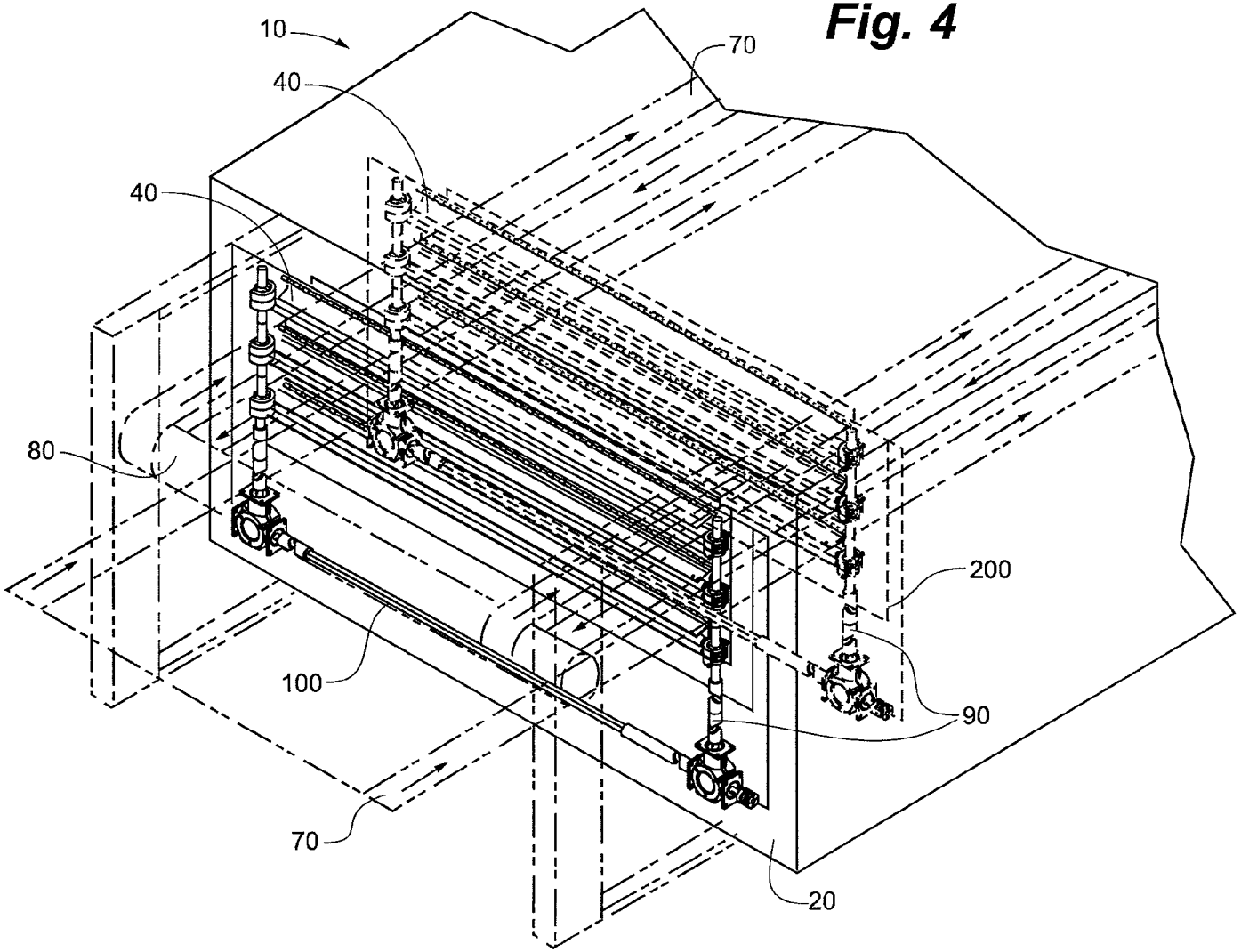
FIG. 4 is a perspective view of an oven in accordance with embodiments of the invention.

FIG. 4 is a perspective view of an oven in accordance with embodiments of the invention. The embodiment of FIG. 4 has an array of gates similar to that of FIG. 1 located outside of the end wall 20 of the oven. In this embodiment, there is an interior wall 200 and a second array of gates located outside of the interior wall 200 and between that wall and end wall 20. An oven of this type might be constructed to reduce the potential for pollutants or byproducts from the fiber treatment processes to be released to the atmosphere. The region between the two walls 20 and 200 can be and independently vented to remove byproducts that pass by the gates at interior wall 200. By maintaining the area between these two walls, referred to herein as a vestibule, at a pressure slightly below the atmospheric pressure byproducts from the process oven and exterior air from outside of gate 20 are both removed from the vestibule and essentially no outside air enters the process and no process gases escape to the environment.

Figure 5:
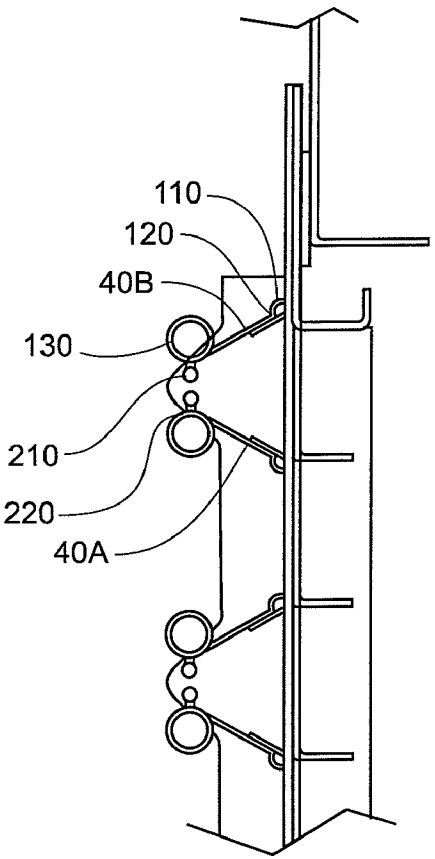
FIG. 5 is a cross section of an end view of a set of gates in accordance with embodiments of the invention.

FIG. 5 is a cross section of an end view of a set of gates in accordance with embodiments of the invention. The gates 40A and 40B and connected to the end wall by hinges 110 at their proximal ends 120. There is a track 220 that retains a bumper 210. Bumper 210 in this embodiment is hollow to allow for deformation by knots or tangles that may form in the fibers as they pass between the gates 40A and 40B. In the embodiment shown in FIG. 5 the gates 40 are generally in a more closed position. In this position the bumpers 210 are oriented so that they are closer to any normally oriented fiber tow than any other part of the gate. In this way they can reduce damage to the fiber as it passes through between the gates. Gates with bumpers like this, or others that will be obvious upon reading this disclosure, may be able to be placed closer to the fiber tows than gates without such bumpers because gates without bumpers may cause more damage to the fibers or even break the fibers resulting in possible equipment downtime. They ability to place the gates closer to the fiber tows may improve on oven energy efficiency, processing stability, and environmental compliance, for example.

Figure 6:
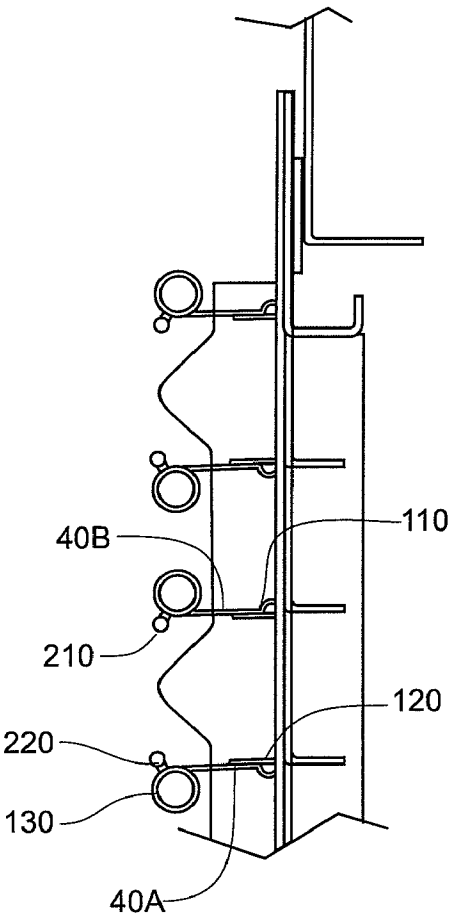
FIG. 6 is a cross section of an end view of a set of gates in accordance with embodiments of the invention.

FIG. 6 is a cross section of an end view of a set of gates in accordance with embodiments of the invention. In this Figure the gates 40A and 40B are more generally open, but the track 220 and the bumper 210 are still oriented so that they will be closest to the fiber tows in most operating positions. The track 220 is configured so that a bumper 210 may be slid into the track and retained there by flanges on the track that engage the tadpole style bumper. These tracks and bumpers are well known in the furnace and oven arts, although they are more frequently used to help seal doors and other openings. The track/tadpole system allows for the replacement of bumpers by sliding them out of the tracks in a longitudinal direction. It may be desirable to replace bumpers that have been degraded by contact with fibers, exposure to hot gases from the oven, exposure to byproducts of fiber processing, or any number of reasons. Bumpers in accordance with embodiments of the invention may be readily replaced and bumpers of different materials of construction can be easily substituted if desired. Other compressible bumpers and other surface treatments for the gates will occur to one of skill in the art upon reading this disclosure.

While a preferred embodiment of the present invention has been described, it should be understood that various changes, adaptations and modifications may be made therein without departing from the spirit of the invention and the scope of the appended claims.

What is claimed is:

1. A fiber treatment oven comprising:

a. a heated enclosure for heating fibers as the fibers are drawn through the enclosure, the enclosure having two end walls;

b. a plurality of slots in the end walls to allow fibers to be fed to and from the enclosure, wherein a rotating gate is disposed above each of the plurality of slots and a complementary rotating gate is disposed below each of the plurality of slots, and wherein the gates are attached to the end wall at a proximal edge by hinges and are operatively connected to a first linkage at a first end of a distal edge;

c. a plurality of adjustable gates located proximate the slots and configured to increase or decrease the effective area of the slots; and d. a linkage connecting at least some of the gates so that more than one gate can be adjusted at a time.

2. The oven of claim 1, further comprising hinges on which the adjustable gates pivot.

3. The oven of claim 1, wherein the gates are driven by a reciprocating linkage.

4. The oven of claim 1, wherein the gates are driven by a rotating linkage.

5. The oven of claim 1, further comprising a flexible bumper on the portion of a gate that is proximate the fibers.

6. The oven of claim 1, further comprising a drive unit to drive the rotation of the linkage and a universal joint that compensates for the movement of the linkage caused when the distal edges of the gates rotate.

7. The oven of claim 1, wherein:

a. the distal edges of the gates are operatively connected to nuts;

b. the nuts on the gates above each slot are threaded in the opposite direction from the nuts on the gates below each slot; and c. the nuts are threaded onto the first linkage, the first linkage having alternating thread directions to match each nut so that when the first linkage is rotated the gates above each slot move in opposite directions from the gates below each slot.

8. The oven of claim 7, further comprising a collar that attaches the nut to the gate, the collar being selectively secured to the nut so that the nut can be moved along the linkage to a new position and then secured again to the collar at the new position.

9. The oven of claim 1, wherein the gates are operatively connected to a second linkage at a second end of the gates generally opposite the first end.

10. The oven of claim 9, wherein both linkages are operatively connected so that they can be rotated to essentially the same degree at the same time.

11. An oven for treating fibers comprising:

a. a housing defining a plurality of spaced, parallel pathways for a plurality of fibers to traverse the interior of the housing in the direction of and along said pathways;

b. a roller located outside of the housing to collect fibers at the end of a pathway and to direct fibers to a next pathway;

c. a plurality of slots in the housing to allow the fibers to enter and exit the housing;

d. a plurality of adjustable gates located proximate the slots and configured to increase or decrease the effective area of the slots;

e. a linkage connecting at least some of the gates so that more than one gate can be adjusted at a time;

f. a flexible bumper on a portion of a gate proximate the fibers; and g. a drive unit to drive the rotation of the linkage and a universal joint that compensates for the movement of the linkage caused when the distal edges of the gates rotate.

12. The oven of claim 11, further comprising:

a. a rotating gate disposed above each of a plurality of slots and a complementary rotating gate disposed below each of a plurality of slots, wherein the gates have a proximal edge and a distal edge along the length of the gate, and a first end and a second end, and are attached to the housing at the proximal edges by hinges;

b. nuts operatively connected to the ends of the gates proximate the distal edges, wherein the nuts on the gates above each slot are threaded in the opposite direction from the nuts on the gates below each slot; and c. the linkage, having alternating thread directions to match each nut so that when the linkage is rotated in one direction the gates above the slot pivot so that their distal edges move downward while the gates below the slot pivot so that their distal edges move upward, the combination of the distal edges of the gates moving toward each other reducing the effective area of the slot.

13. An oven for treating fibers comprising:

a. a housing defining a plurality of spaced, parallel pathways for a plurality of fibers to traverse the interior of the housing in the direction of and along said pathways;

b. a plurality of slots in the housing to allow the fibers to enter and exit the housing;

c. a vestibule at the end of the housing having a plurality of slots to allow the fibers to enter and exit the vestibule, both the housing and the vestibule comprising:

i. a rotating gate disposed above each of a plurality of slots in the vestibule and housing and a complementary rotating gate disposed below each of a plurality of slots in the vestibule and housing, wherein the gates have a proximal edge and a distal edge along the length of the gate, and a first end and a second end, and are attached to the housing or vestibule at the proximal edges by hinges;

ii. nuts operatively connected to the ends of the gates proximate the distal edges, wherein the nuts on the gates above each slot are threaded in the opposite direction from the nuts on the gates below each slot; and iii. a linkage connecting at least some of the gates of the housing and a second linkage connecting at least some of the gates of the vestibule, so that more than one gate at the housing and more than one gate at the vestibule can be adjusted at a time, the linkages having alternating thread directions to match each nut so that when the linkages are rotated in one direction the gates above the slot pivot so that their distal edges move downward while the gates below the slot pivot so that their distal edges move upward, the combination of the distal edges of the gates moving toward each other reducing the effective area of the slot.

14. The oven of claim 13, further comprising a drive unit to drive the rotation of the linkage that is outside of the vestibule and a universal joint that compensates for the movement of this linkage caused when the distal edges of the gates rotate.

15. The oven of claim 13, further comprising a flexible bumper on a portion of a gate proximate the fibers.

16. The oven of claim 13, further comprising a vent on the vestibule for removing gases that have entered the vestibule form the oven or from the outside environment.

* * * * *